US008007238B2

(12) United States Patent
Yao

(10) Patent No.: US 8,007,238 B2
(45) Date of Patent: Aug. 30, 2011

(54) HANGING FAN WITH A CEILING MOUNT STRUCTURE

(76) Inventor: Chao-chin Yao, Taichung (TW)

( * ) Notice: Subject to any disclaimer, the term of this patent is extended or adjusted under 35 U.S.C. 154(b) by 420 days.

(21) Appl. No.: 12/399,931

(22) Filed: Mar. 7, 2009

(65) Prior Publication Data

US 2010/0226784 A1 Sep. 9, 2010

(51) Int. Cl.
*F01D 5/08* (2006.01)

(52) U.S. Cl. ..... 416/146 R; 416/210 R; 416/244 R

(58) Field of Classification Search ..... 416/146 R, 416/210 R, 244 R
See application file for complete search history.

(56) References Cited

U.S. PATENT DOCUMENTS

| | | | | | |
|---|---|---|---|---|---|
| 4,357,506 | A * | 11/1982 | Breining | 200/52 R |
| 4,548,554 | A * | 10/1985 | Angott | 417/572 |
| 6,042,072 | A * | 3/2000 | Chi-Nan | 248/343 |
| 6,102,663 | A * | 8/2000 | Wang | 416/244 R |
| 6,139,279 | A * | 10/2000 | Pearce et al. | 416/244 R |
| 6,200,099 | B1 * | 3/2001 | Liao | 416/244 R |
| 6,382,917 | B1 * | 5/2002 | Zuege | 416/210 R |
| 6,439,527 | B1 * | 8/2002 | Lin | 248/343 |
| 6,790,008 | B1 * | 9/2004 | Huang | 416/244 R |
| 2004/0005218 | A1 * | 1/2004 | Marshall | 416/146 R |
| 2008/0181782 | A1 * | 7/2008 | Pearce | 416/244 R |

* cited by examiner

*Primary Examiner* — Michael Lebentritt
(74) *Attorney, Agent, or Firm* — Wang Law Firm, Inc.; Li K. Wang

(57) ABSTRACT

A hanging fan with a ceiling mount structure includes a ceiling mount disc mounted to a ceiling, an external disc portion having a plurality of arc slots, a cover having a transversal extending portion, and a fixing portion disposed at the extending portion, such that the fixing portion of the cover is passed through the arc slot and fixed with the ceiling mount disc to form the hanging fan structure of the invention.

6 Claims, 7 Drawing Sheets

HANGING FAN WITH A CEILING MOUNT STRUCTURE

BACKGROUND OF THE INVENTION

1. Field of the Invention

The present invention relates to a hanging fan, in particular to a hanging fan with a ceiling mount structure.

2. Description of the Related Art

With reference to FIG. 7 for a conventional ceiling mount structure of a hanging fan, the ceiling mount structure includes a rectangular ceiling mount base 90 mounted to a ceiling 91 and having a hanging fan motor 92 installed thereon, and a cover 93 with an opening for covering the hanging fan motor 92 and the ceiling mount base 91, and a screw 901 individually passed through the cover 93 and fixed to both ends of the ceiling mount base 90.

When the cover 93 is secured to the ceiling mount base 90, the cover 93 is lifted to align its through hole 931 with a screw hole (not shown in the figure) individually disposed at both ends of the ceiling mount base 90, and then the screw 901 is passed through and secured with the cover 93. In general, the cover 93 and the ceiling mount base 90 are fixed to their positions at a height proximate to the ceiling 91, and thus it is relatively difficult and inconvenient to align and fix the cover 93 and the ceiling mount base 90 into their desired positions.

Therefore, it is an important subject for the present invention to overcome the aforementioned ceiling mount issue of the prior art.

SUMMARY OF THE INVENTION

Therefore, it is a primary objective of the present invention to provide a hanging fan with a ceiling mount structure to achieve the effects of requiring simple components and providing a convenient and quick installation.

To achieve the foregoing objective, the present invention provides a ceiling mount structure for a hanging fan, and the ceiling mount structure comprises:

a ceiling mount disc, secured to a ceiling, and integrally formed, and comprised of an internal disc portion and an external disc portion, and the internal disc portion being protruded in a direction of securing the external disc portion, and the external disc portion having a flange disposed at the periphery of the external disc portion and extended towards the securing direction and situated at a height lower than the internal disc portion, and the internal disc portion having a plurality of through holes for receiving a plurality of screws, and the external disc portion having a plurality of arc slots, and each arc slot being interconnected to a circular hole at the same end and having a hole diameter greater than the width of the arc slot, and the external disc portion having a first screw thread portion disposed between the arc slot and the internal disc portion for mounting a hanging fan motor; and a cover, being hollow, and covered onto the hanging fan motor, and having an opening disposed at an end of the cover for engaging the external periphery of the ceiling mount disc, and the cover having a plurality of inwardly and transversally extended extending portions disposed proximate to the opening, and each extending portion including at least one height adjustable fixing portion, and the fixing portion having a width smaller than the circular hole and greater than the arc slot, and a gasket being installed between the fixing portion and the extending portion for producing a resistance along a sliding direction between the fixing portion and the extending portion.

DETAILED DESCRIPTION OF THE PREFERRED EMBODIMENTS

Figure 1:
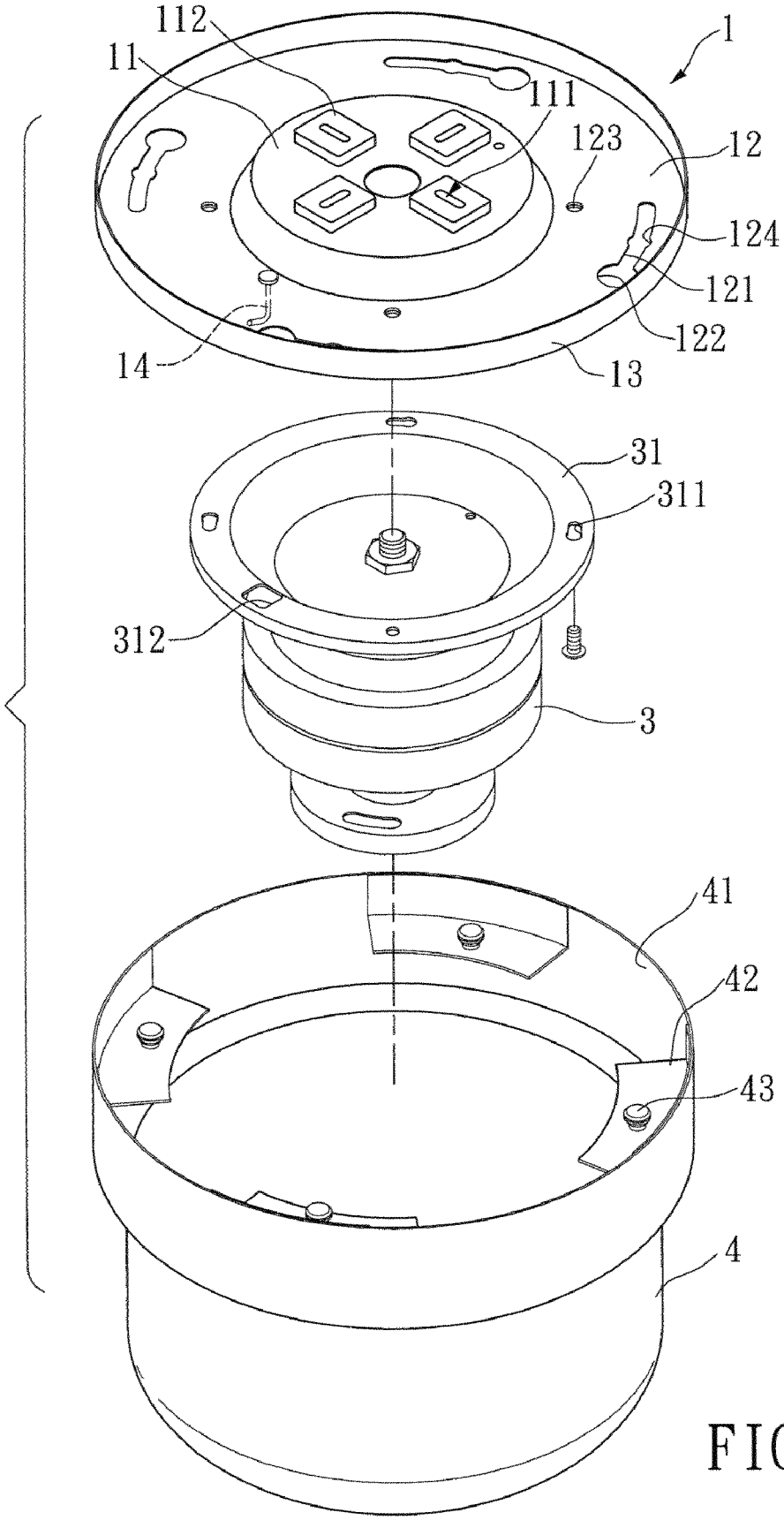
FIG. 1 is an exploded view of a hanging fan in accordance with the present invention.
Figure 2:
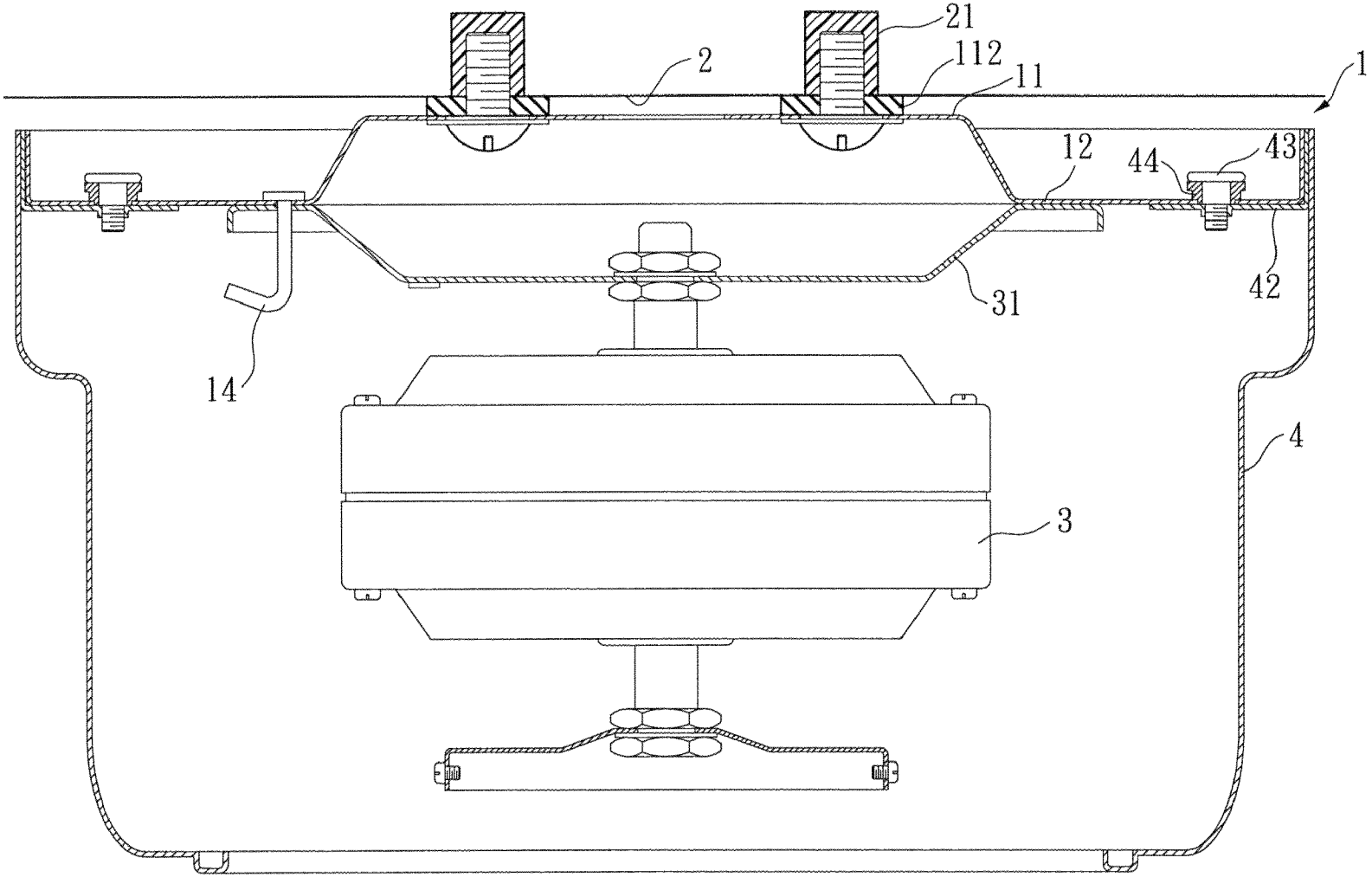
FIG. 2 is a cross-sectional view of a hanging fan in accordance with the present invention.

The present invention will now be described in more detail hereinafter with reference to the accompanying drawings that show various embodiments of the invention as follows. It is noteworthy to point out that the drawings FIGS. 1 to 6 are provided for the purpose of illustrating the present invention only, but not intended for limiting the scope of the invention.

In a preferred embodiment, the present invention provides a hanging fan with a ceiling mount structure, comprising the following elements:

A ceiling mount disc 1 is mounted to a ceiling 2, and integrally formed, and comprised of an internal disc portion 11 and an external disc portion 12. The internal disc portion 11 is protruded in a direction of securing the external disc portion 12, and has a flange 13 disposed at the periphery of the external disc portion 12 and extended in the securing the external disc portion 12, and the flange 13 has a height lower than the height of the internal disc portion 11, and the internal disc portion 11 includes a plurality of through holes 111 for receiving a plurality of screws.

The internal disc portion 11 includes a soft pad 112 disposed at a position corresponding to each through hole 111, and a screw is passed through the through hole 111 and secured to the ceiling 2, and the soft pad 112 is installed on the internal disc portion 11 and included between the internal disc portion 11 and the ceiling 2 for achieving the fixing and shock absorbing effects.

The external disc portion 12 includes a plurality of arc slots 121, and each arc slot 121 at the same end is interconnected to a circular hole 122, and the circular hole 122 has a hole diameter greater than the width of the arc slot 121. The external disc portion 12 further includes a plurality of first screw thread portions 123 disposed between the arc slot 121 and the internal disc portion 11 for mounting the hanging fan motor 3. In this preferred embodiment, the plurality of first screw thread portions 123 include four symmetric screw holes disposed at the external disc portion 12 and proximate to the periphery of the internal disc portion 11.

A cover 4 is covered onto the hanging fan motor 3, wherein the cover 4 is hollow and an end of the cover 4 is engaged with an opening 41 at the external periphery of the ceiling mount disc 1. The cover 4 includes a plurality of extending portions 42 disposed proximate to the opening 41, and each extending portion 42 is extended inwardly and transversally in the cover 4.

At least one fixing portion 43 is coupled to the extending portion 12 in a direction towards the opening, and the fixing portion 43 has a width smaller than the circular hole 122 and greater than the arc slot 121.

The fixing portion 43 includes an elastic gasket 44 for providing a resistance along a sliding direction between the fixing portion 43 and the extending portion 42 to prevent the fixing portion 43 and the extending portion 42 from sliding with respect to each other due to the vibration produced by the rotation of the hanging fan.

Figure 3:
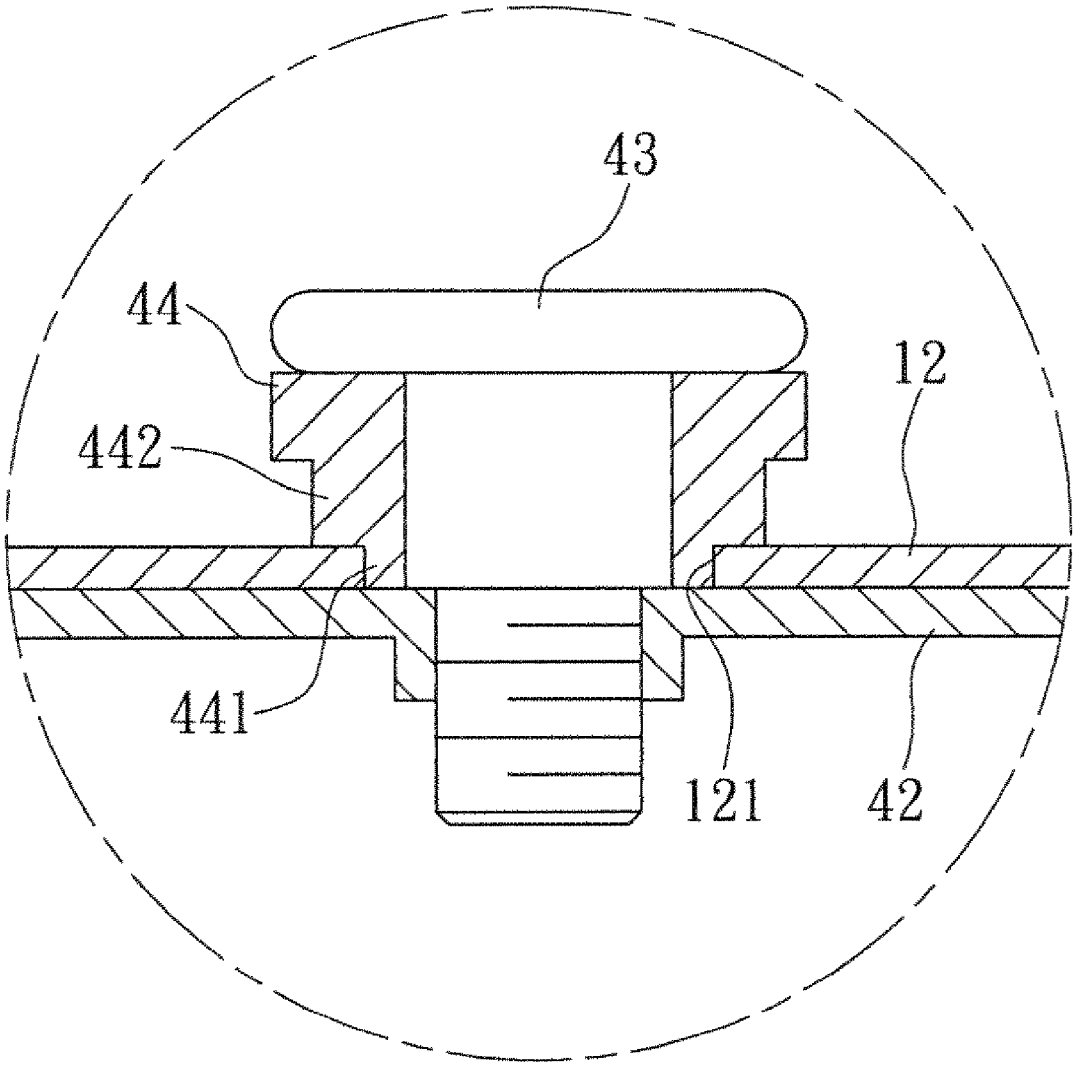
FIG. 3 is a partial cross-sectional view of securing a fixing portion of FIG. 2.

In this preferred embodiment, the gasket 44 is sheathed to the fixing portion 43, and the gasket 44 is a tapered step structure. In the figure, the fixing portion 43 is engaged with the extending portion 42, and thus the height of the fixing portion 43 can be adjusted according to the thickness of the external disc portion 12 or the tightness of connecting the external disc portion 12. In FIG. 3, the gasket 44 at the last step 441 has an external diameter smaller than the width of arc slot 121, and the gasket 44 at the previous step 442 has an external diameter greater than the width of the arc slot 121, such that the gasket 44 can be embedded into the arc slot 121 successfully by the difference of these two steps 441, 442, and the height of securing the fixing portion 43 can be adjusted, and the previous step 442 in the arc slot 121 gently abuts the periphery of the external disc portion 12.

In this preferred embodiment, the external disc portion 12 includes a hook portion 14 disposed proximate to a side of the internal disc portion 11, and the hanging fan motor 3 includes a connect disc 31 coupled to a first screw thread portion 123 of the internal disc portion 11, and the connect disc 31 has a plurality of key-shaped through holes 311, and the through hole 311 is aligned with the first screw thread portion 123 of the internal disc portion 11. The connect disc further includes a hook hole 312 for passing and hooking the hook portion 14 in advance for facilitating the installation and preventing the hanging fan motor 3 from falling by accidents. In the figure, this preferred embodiment has three through holes 311, and the hook hole 312 is substantially in a rectangular shape.

Figure 4:
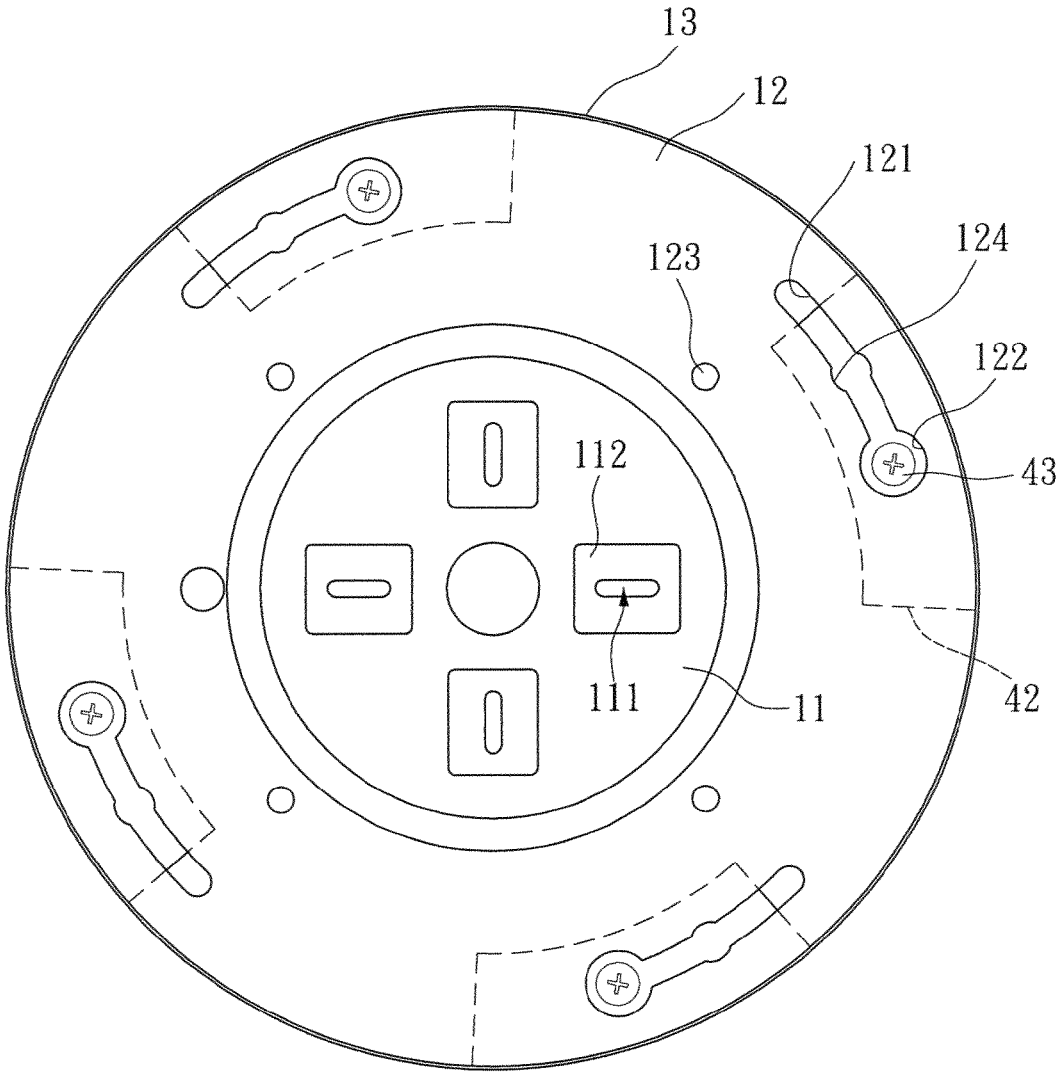
FIG. 4 is a schematic view of a ceiling mount disc and a cover before they are fixed to their positions in accordance with the present invention.
Figure 5:
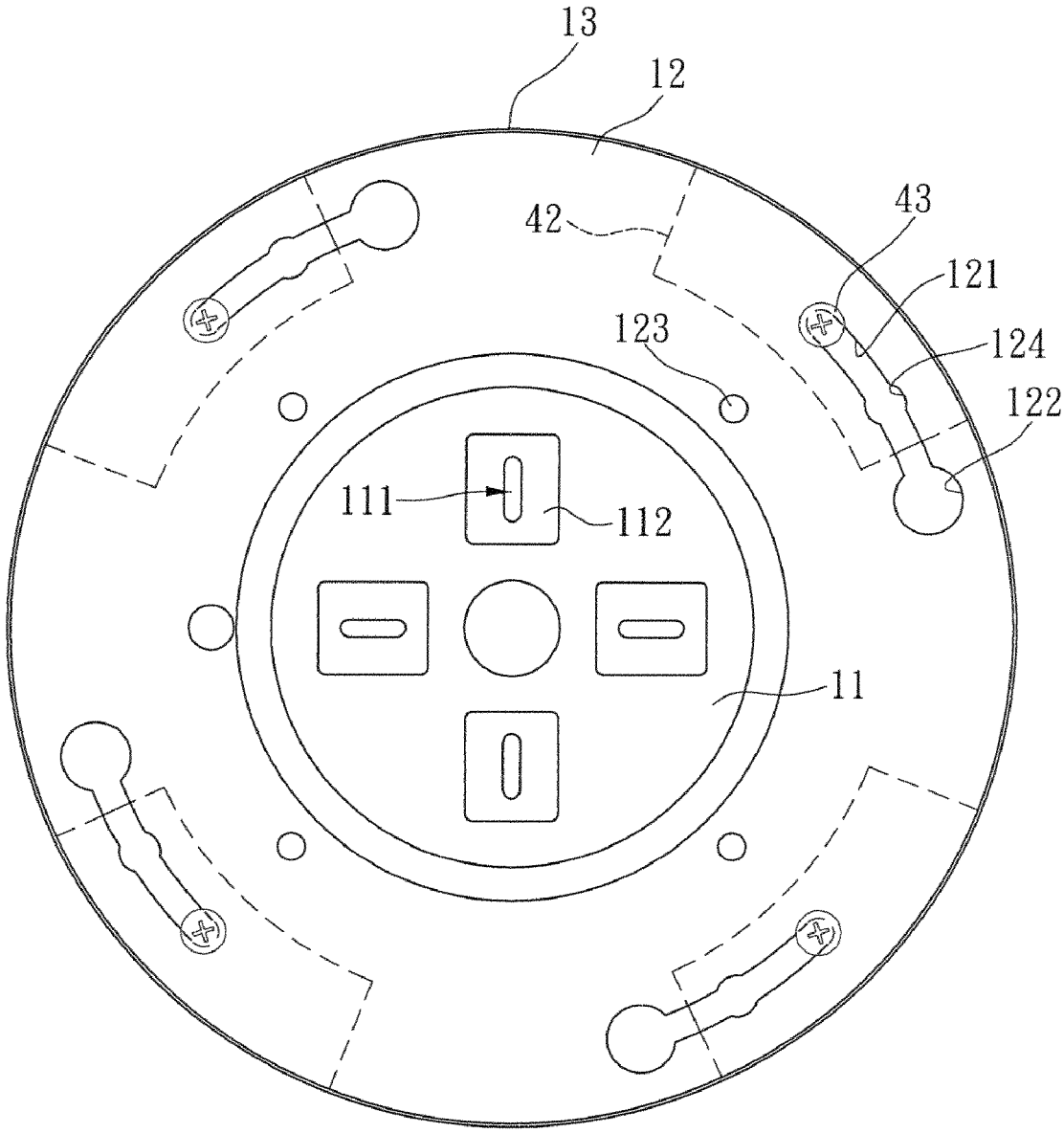
FIG. 5 is a schematic view of a ceiling mount disc and a cover after they are fixed to their positions in accordance with the present invention.

From the description above, the ceiling mount disc 1 is mounted to the ceiling 2, and as shown in FIGS. 4 and 5, the fixing portion 43 on the extending portion 42 of the cover 4 is aligned precisely with the circular hole 122 on the ceiling mount disc 1 and turned clockwise towards the inside of the arc slot 121 after the fixing portion 43 is installed into the circular hole 122, and the fixing portion 43 is adjusted to a predetermined height, and the gasket 44 is compressed at the external disc portion 12 for fixing the cover 4 onto the ceiling mount disc 1.

Figure 6:
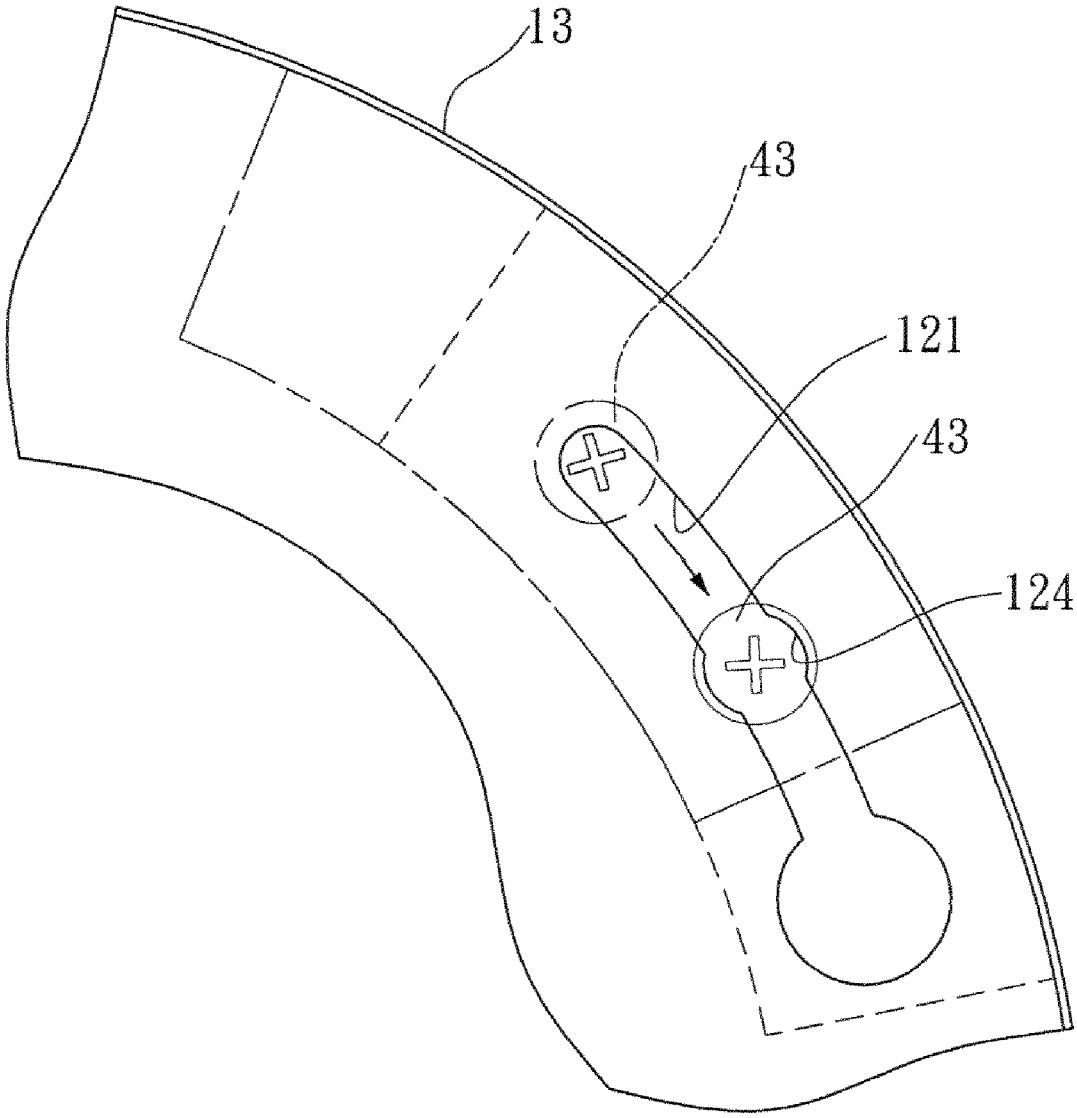
FIG. 6 is a schematic view of a fixing portion embedded into a positioning hole in accordance with the present invention.
Figure 7:
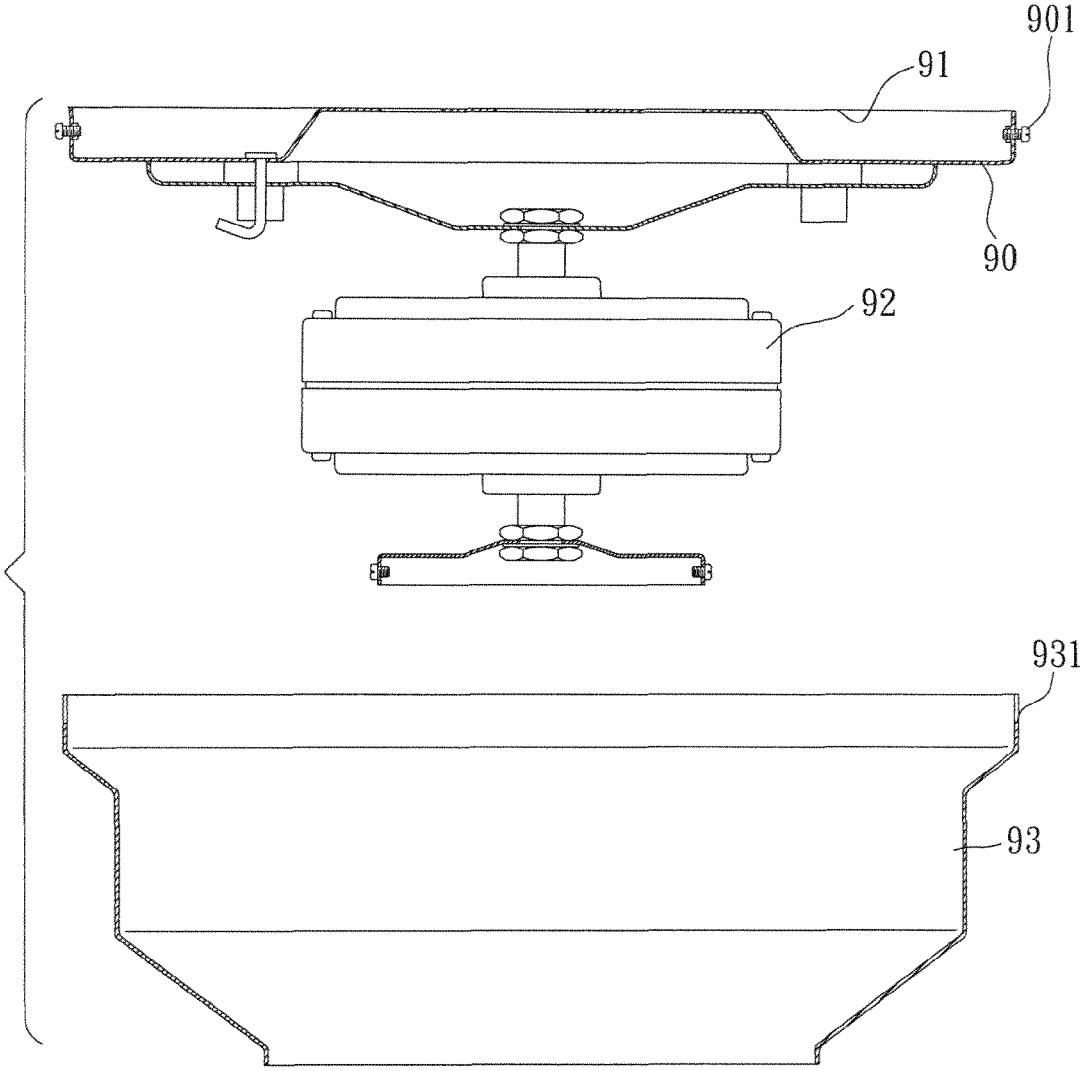
FIG. 7 PRIOR ART
FIG. 7 is a schematic view of a conventional ceiling mount structure of a hanging fan.

In this preferred embodiment, a positioning hole 124 is disposed between both ends of the arc slot 121 of the external disc portion 12. Vibrations are produced during the rotation of the hanging fan, and the fixing portion 43 may be loosened and slid with respect to the extending portion 42 easily, such that the hood 4 may be separated from the ceiling mount disc 1 easily. Therefore, the structural design of the positioning hole 124 in accordance with the preferred embodiment as shown in FIG. 6 is provided. If the fixing portion 43 is loosened and slid with respect to the extending portion 42 the fixing portion 43 will sink into the positioning hole 124 in the middle of the sliding movement to prevent the sliding of the fixing portion 43 and the extending portion 42 with respect to each other, so as to prevent the hood 4 from separating or falling from the ceiling mount disc 1.

In summation of the description above, the present invention has an easy fixing effect by simply turning the cover 4 after the fixing portion 43 is embedded into the arc slot 121 of the ceiling mount disc 1. With a simple structure, the cover 4 can be installed to the ceiling mount disc 1 conveniently and quickly at a height proximate to the ceiling 2.

What is claimed is:

1. A hanging fan with a ceiling mount structure, comprising:

a ceiling mount disc, secured to a ceiling, and integrally formed, and comprised of an internal disc portion and an external disc portion, and the internal disc portion being protruded in a direction of securing the external disc portion, and the external disc portion having a flange disposed at the periphery of the external disc portion and extended towards the securing direction and situated at a height lower than the internal disc portion, and the internal disc portion having a plurality of through holes for receiving a plurality of screws, and the external disc portion having a plurality of arc slots, and each arc slot being interconnected to a circular hole at the same end and having a hole diameter greater than the width of the arc slot, and the external disc portion having a first screw thread portion disposed between the arc slot and the internal disc portion for mounting a hanging fan motor; and a cover, being hollow, and covered onto the hanging fan motor, and having an opening disposed at an end of the cover for engaging the external periphery of the ceiling mount disc, and the cover having a plurality of inwardly and transversally extended extending portions disposed proximate to the opening, and each extending portion including at least one height adjustable fixing portion, and the fixing portion having a width smaller than the circular hole and greater than the arc slot, and a gasket being installed between the fixing portion and the extending portion for producing a resistance along a sliding direction between the fixing portion and the extending portion.

2. The hanging fan with a ceiling mount structure as recited in claim 1, further comprising a positioning hole disposed between both ends of the arc slot and interconnected with the arc slot for embedding the fixing portion when the fixing portion is slid out.

3. The hanging fan with a ceiling mount structure as recited in claim 1, wherein the external disc portion includes a hook portion disposed proximate to a side of the internal disc portion for hooking the hanging fan motor before the hanging fan motor is mounted.

4. The hanging fan with a ceiling mount structure as recited in claim 3, wherein the hanging fan motor includes a connect disc secured to the first screw thread portion of the internal disc portion, and the connect disc includes a plurality of key-shaped through holes disposed thereon and corresponding to the first screw thread portions of the internal disc portion, and a hook hole for passing and hooking the hook portion in advance.

5. The hanging fan with a ceiling mount structure as recited in claim 1, wherein the internal disc portion includes a soft pad disposed at a position corresponding to each through hole for attaching the ceiling.

6. The hanging fan with a ceiling mount structure as recited in claim 1, wherein the gasket is sheathed to the fixing portion, and the gasket is a tapered step structure.

* * * * *